US012063966B2

(12) United States Patent
Van Lancker et al.

(10) Patent No.: US 12,063,966 B2
(45) Date of Patent: Aug. 20, 2024

(54) AEROSOL-GENERATING DEVICE WITH SHAPE MEMORY HEATER

(71) Applicant: Philip Morris Products S.A., Neuchatel (CH)

(72) Inventors: Pieter Van Lancker, Kortrijk (BE); Louis-Philippe Vancraeynest, Kortrijk (BE); Simon Desnerck, Kortrijk (BE)

(73) Assignee: Philip Morris Products S.A., Neuchatel (CH)

( * ) Notice: Subject to any disclaimer, the term of this patent is extended or adjusted under 35 U.S.C. 154(b) by 799 days.

(21) Appl. No.: 17/251,376

(22) PCT Filed: Jun. 13, 2019

(86) PCT No.: PCT/EP2019/065474
§ 371 (c)(1),
(2) Date: Dec. 11, 2020

(87) PCT Pub. No.: WO2019/238814
PCT Pub. Date: Dec. 19, 2019

(65) Prior Publication Data

US 2021/0244100 A1 Aug. 12, 2021

(30) Foreign Application Priority Data

Jun. 14, 2018 (EP) ..... 18177749

(51) Int. Cl.
*A24F 40/46* (2020.01)
*A24F 40/42* (2020.01)
*A24F 40/20* (2020.01)

(52) U.S. Cl.
CPC ..... *A24F 40/46* (2020.01); *A24F 40/42* (2020.01); *A24F 40/20* (2020.01)

(58) Field of Classification Search
CPC ..... A24F 40/20; A24F 40/42; A24F 40/46
(Continued)

(56) References Cited

U.S. PATENT DOCUMENTS 9,717,276 B2 * 8/2017 Brammer ..... A61M 15/025
2015/0117841 A1 * 4/2015 Brammer ..... H05B 3/02
(Continued)

FOREIGN PATENT DOCUMENTS

CA 2824453 A1 * 6/2012 ..... A24F 40/53
CN 105072935 A 11/2015
(Continued)

OTHER PUBLICATIONS

Office Action issued Sep. 3, 2022, in corresponding Korean Patent Application No. 10-2020-7035712 (with English Translation), 9 pages.
(Continued)

*Primary Examiner* — Peter G Leigh
(74) *Attorney, Agent, or Firm* — Oblon, McClelland, Maier & Neustadt, L.L.P.

(57) ABSTRACT

An aerosol-generating device for generating an inhalable aerosol is provided, the aerosol-generating device including: a heating chamber configured to receive an aerosol-generating article containing an aerosol-generating substrate; and a heating element disposed in the heating chamber, material of the heating element being configured to penetrate into the aerosol-generating article, and the material of the heating element including one or more of a shape memory alloy, a shape memory polymer, and a shape memory ceramic. A method for generating an inhalable aerosol with an aerosol-generating device is also provided.

17 Claims, 5 Drawing Sheets

Figures 2, 2A, 2B, 2C:
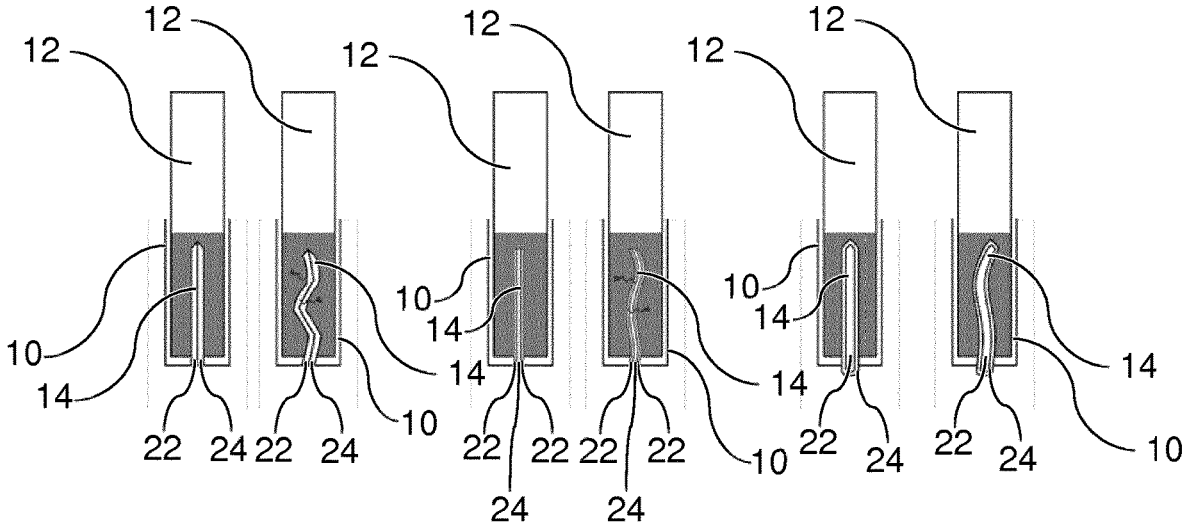

(58) Field of Classification Search
USPC ..... 131/329
See application file for complete search history.

(56) References Cited

U.S. PATENT DOCUMENTS

| | | | | |
|---|---|---|---|---|
| 2015/0117842 | A1* | 4/2015 | Brammer | A61M 15/06 |
| 2015/0181935 | A1* | 7/2015 | Lyubomirskiy | A24F 40/46 392/386 |
| 2015/0217064 | A1 | 8/2015 | Trzecieski | |
| 2015/0344690 | A1 | 12/2015 | Hu et al. | |
| 2016/0021931 | A1 | 1/2016 | Hawes et al. | |
| 2017/0055580 | A1* | 3/2017 | Blandino | H05B 6/36 |
| 2017/0172215 | A1 | 6/2017 | Li et al. | |
| 2018/0206552 | A1* | 7/2018 | Sebastian | A24F 40/46 |

FOREIGN PATENT DOCUMENTS

| | | | | |
|---|---|---|---|---|
| CN | 106617324 | A | 5/2017 | |
| EA | 019736 | B1 | 5/2014 | |
| EP | 3 179 828 | A1 | 6/2017 | |
| JP | 11-145659 | A | 5/1999 | |
| JP | 2004-245155 | A | 9/2004 | |
| JP | 2011-503486 | A | 1/2011 | |
| JP | 2017-221213 | A | 12/2017 | |
| KR | 10-2017-0020917 | A | 2/2017 | |
| KR | 10-2018-0033295 | A1 | 4/2018 | |
| RU | 107 026 | U1 | 8/2011 | |
| WO | WO 2009/063131 | A1 | 5/2009 | |
| WO | WO 2016/156497 | A1 | 10/2016 | |
| WO | WO 2017/036950 | A2 | 3/2017 | |
| WO | WO-2017036950 | A2 * | 3/2017 | A24D 1/20 |
| WO | WO-2017112476 | A2 * | 6/2017 | A61M 15/009 |

OTHER PUBLICATIONS

Japanese Office Action issued Jan. 26, 2022 in Patent Application No. 2020-568680, (submitting English translation only), 5 pages.

Combined Chinese Office Action and Search Report issued on Apr. 29, 2023 in Chinese Patent Application No. 201980067954.5 (with English translation), 14 pages.

Edited by Hubei Press Dictionary "Common Encyclopedia Dictionary" Published on Jul. 31, 1991, p. 144 (with cover page).

Korean Notice of Final Rejection issued Mar. 28, 2023 in Korean Patent Application No. 10-2020-7035712 (with English Translation), 9 pages.

Decision of Grant issued Jul. 21, 2021 in corresponding Russian Patent Application No. 2021100160/03(000281) (English Translation only), 6 pages.

International Search Report and Written Opinion issued on Aug. 13, 2019 in PCT/EP2019/065474 filed on Jun. 13, 2019.

Combined Chinese Office Action and Search Report issued Aug. 31, 2023, in corresponding Chinese Patent Application No. 201980039452.1 (with English Translation), 12 pages.

* cited by examiner

Fig. 1
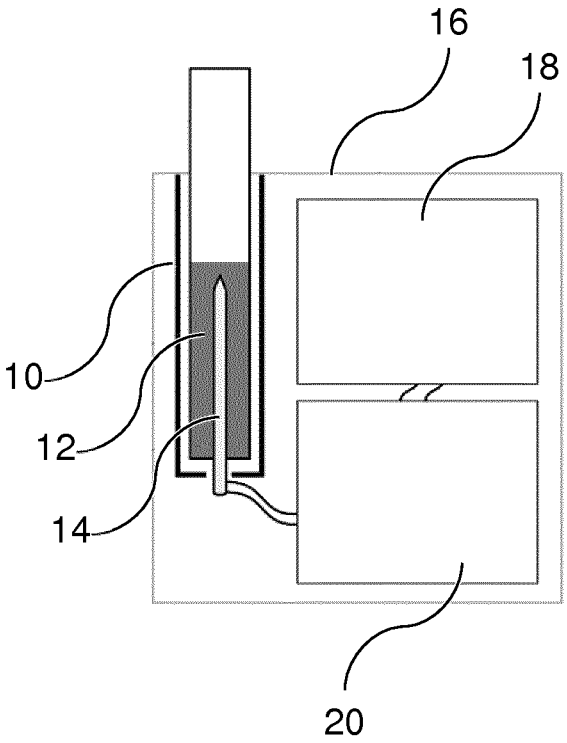
Fig. 1A
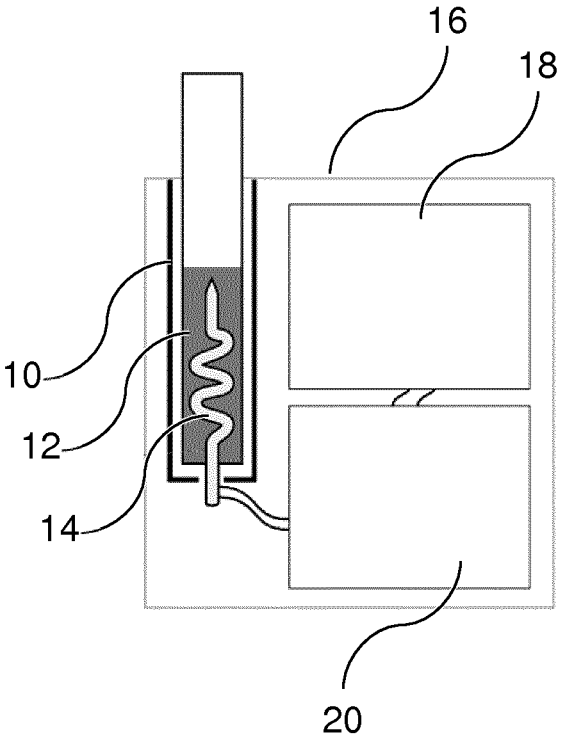
Fig. 1B

AEROSOL-GENERATING DEVICE WITH SHAPE MEMORY HEATER

The invention relates to an aerosol-generating device for generating an inhalable aerosol. Aerosol-generating devices are known which heat but not burn aerosol-generating substrate such as tobacco. These devices heat aerosol-generating substrate to a sufficiently high temperature for creating an aerosol for inhalation by the user.

These aerosol-generating devices typically comprise a heating chamber, wherein a heating element is arranged within the heating chamber. An aerosol-generating article comprising aerosol-generating substrate can be inserted into the heating chamber and heated by the heating element. The heating element is typically configured as a heating pin and penetrates into the aerosol-generating substrate of the aerosol-generating article when the article is inserted into the heating chamber. The heating element predominantly heats the substrate directly surrounding the heating element. Substrate which is arranged distanced from the heating element near the outer circumference of the article is heated to a lesser degree. Uneven heating of the substrate may be the result.

Consequently, there is a need for optimizing heating and thus aerosol generation of an aerosol-generating device.

For solving this and further objects, the present invention proposes an aerosol-generating device for generating an inhalable aerosol. The device comprises a heating chamber configured to receive an aerosol-generating article containing aerosol-generating substrate and a heating element arranged in the heating chamber. The heating element is configured to penetrate into the aerosol-generating article. The heating element comprises one or more of a shape memory alloy, a shape memory polymer, a shape memory ceramic and bimetal.

By means of the material of the heating element, the shape of the heating element is preferably changed during the heating operation in a way that the surface area between the heating element and the aerosol-generating substrate is increased. Hence, the heating element is preferably configured to change its shape during the heating operation. The aerosol-generation may be optimized during the heating operation due to the changed shape of the heating element. Preferably, the initial shape of the heating element is provided such that the aerosol-generating article inserted into the heating chamber can easily be inserted into the heating chamber. For example, the heating element may have the shape of a heating pin or heating blade in the initial position. After the aerosol-generating article has been inserted into the heating chamber and the heating element has penetrated into the aerosol-generating substrate contained in the article, the shape of the heating element is changed. The heating element preferably is changed into a shape which is not straight but is bent or twisted so that the contact surface with the aerosol-generating substrate is increased. After change of shape, the heating element may have a coil or wound shape.

The change of shape of the heating element may be utilized to secure the aerosol-generating article within the heating chamber. In this regard, the aerosol-generating article may be clamped inside of the heating chamber due to the change of shape of the heating element. Undesired removal or position change of the article may be prevented by the change of shape of the heating element similar to a corkscrew being arranged inside a cork.

The heating operation may also be denoted as heating cycle. The heating operation is initiated by activation of the heating element. The heating element may be activated by means of a button. The heating element may be activated by a sensor detecting the insertion of an aerosol-generating article. The heating element may be activated by means of a communication interface communicating with an external device such as a smartphone or a smartwatch. The heating operation may start with the activation of the heating element and end with the deactivation of the heating element.

After the heating operation has ended, the heating element preferably returns to its initial shape. This preferably facilitates ease of removal of the aerosol-generating article from the heating chamber.

The heating chamber may have a hollow tubular shape for insertion of an aerosol-generating article with a cylindrical shape resembling a conventional cigarette. The opening of the heating chamber for inserting the article may be circular. The heating element may be configured as a heating blade arranged centrally in the heating chamber.

The heating element may be configured to change its shape for the duration of the heating operation.

Aerosol generation may be enhanced in this embodiment, since different portions of the aerosol-generating substrate are heated during the course of the heating operation. At the start of the heating operation, a first portion of the aerosol-generating substrate may predominantly be heated. During the course of the heating operation, further portions of the aerosol-generating substrate are predominantly heated due to the progression of the change of shape of the heating element. Hence, a more uniform aerosol-generation is achieved. The heating element may be configured to be arranged in a first shape at the start of the heating operation. The heating element may be configured to have a second shape near the end of the heating operation which is different from the first shape. The heating element may be configured to return from the second shape to the first shape after the end of the heating operation. The heating element may be configured to have multiple distinct different shapes during the heating operation between being in the first shape and the second shape.

The heating element may be configured to change its shape continuously for the duration of the heating operation. The continuous shape change of the heating element results in a more uniform aerosol-generation.

The heating element may be configured to change its shape after specific, preferably predefined, amounts of time to heat specific desired portions of the aerosol-generating substrate.

Shape memory alloys used for the heating element include (not exhaustive): Ag—Cd 44/49 at. % Cd, Au—Cd 46.5/50 at. % Cd, Cu—Al—Ni 14/14.5 wt % Al and 3/4.5 wt % Ni, Cu—Sn approx. 15 at % Sn, Cu—Zn 38.5/41.5 wt. % Zn, Cu—Zn—X (X=Si, Al, Sn), Fe—Pt approx. 25 at. % Pt, Mn—Cu 5/35 at % Cu, Fe—Mn—Si, Co—Ni—Al, Co—Ni—Ga, Ni—Fe—Ga, Ti—Nb, Ni—Ti approx. 55-60 wt % Ni, Ni—Ti—Hf, Ni—Ti—Pd, Ni—Mn—Ga.

Suitable shape memory polymers used for the heating element include (not exhaustive): polyesters, polycarbonates, polyethers, polyamides, polyimides, polyacrylates, polyvinyls, polystyrenes, polyurethanes, polyethylene, polyether urethanes, polyetherimides, polymethacrylates, polyoxymethylene, poly-ε-caprolactone, polydioxanone, polyisoprene, styrene copolymer, styrene-isoprene-butadiene block copolymer, cyanate ester, copolymers of stearyl acrylate and acrylic acid or methyl acrylate, norbonene or dimethaneoctahydronapthalene homopolymers or copolymers, malemide, silicones, natural rubbers, synthetic rubbers, and mixtures and compositions thereof. Further, the shape memory polymers may be reinforced or unreinforced shape memory polymer material.

Shape memory ceramics used for the heating element include (not exhaustive): mica-glass ceramics, beta-spdodumene glass ceramic, 2ZnO—$B_2O_3$ glass-ceramics, a variety of sintered ceramics that contain very little glass phase, including mica ($KMg_3AlSi_3O_{10}F_2$), silicone nitride ($Si_3N_4$), silicone carbide (SiC), zirconia ($ZrO_2$) and alumina ($Al_2O_3$), $ZrO_2$-containing ceramics, Martensitic shape-memory ceramics, The shape-memory effect has been observed in the perovskite-type oxides (Pb, La) (Zr, Ti)$O_3$ (PZSTs), Pb(Zr, Sn, Sn, Ti)$O_3$ (PZSTs), (Pb, La) (Zr, Sn, Ti)$O_3$ (PLSnZTs) and (Pb,Nb) (Zr, Sn, Ti) $O_3$, (Sr, Ba) $Nb_2$ $O_6$ and the hexagonal manganites $RMnO_3$ (R"Ho, Y).

Preferably, the heating element comprises shape memory material, i.e. a shape memory alloy, a shape memory polymer or a shape memory ceramic, for facilitating the change of shape during the heating operation.

The heating element may consist of a shape memory alloy, a shape memory polymer, a shape memory ceramic or bimetal.

If the temperature for operating the heating element is similar or identical to the temperature which is optimal for inducing the shape change of the shape changing material, the shape changing material may beneficially be used as the only material of the heating element.

The heating element may comprise a shape changing portion and a heating portion, wherein the heating portion may be preferably elastic. The heating portion may be made from a known resistive material, while the shape changing portion may comprise a shape memory alloy, a shape memory polymer, a shape memory ceramic or bimetal as described above.

The shape changing portion may be used to facilitate the shape change of the heating element during the heating operation. The heating portion of the heating element may be used to facilitate the heating of the aerosol-generating substrate during the heating operation. The aerosol-generating substrate may comprise tobacco and may optimally generate aerosol at a temperature which may be different from the temperature which is necessary for the shape change of the shape changing portion. The device may thus operate optimally if the heating element is divided into a shape changing portion and a heating portion. The shape changing portion may be attached to or arranged near the heating portion so that the change of shape of the shape changing portion has the effect that the heating portion changes shape as well.

Providing the heating portion elastic enables a return of the heating portion into its initial shape after the heating operation has ended. The shape changing portion may be configured to change its shape from a first shape at the start of the heating operation to a second shape near the end of the heating operation and back to the first shape after the heating operation has ended. The heating portion may follow the shape change of the shape changing portion.

The whole heating element or the heating portion or the shape changing portion may be arranged outside of an inserted aerosol-generating article and heat the aerosol-generating substrate from the outside.

Clamping means may be provided for securely holding the aerosol-generating article within the heating chamber during operation of the device. The clamping means may be configured as a needle or an element similar to a brake shoe. Preferably, the clamping means are provided as a shape changing element comprising a shape memory alloy, a shape memory polymer, a shape memory ceramic or bimetal. The clamping means may be actuated together with the heating element for shape changing. The clamping means may be configured to compress the aerosol-generating article against the heating element.

The device further may comprise a power supply and a controller, wherein the controller may comprise a shape changing controller configured to control power supply to the shape changing portion. The controller may comprise a heating controller configured to control power supply to the heating portion. The supply circuits of the shape changing portion and the heating portion may be configured as separate power supply circuits.

The heating portion may require a larger amount of power delivered by a power supply for heating the aerosol-generating substrate. The shape changing portion may need a lower amount of power for facilitating the shape change. The shape changing portion may need a relatively large amount of power at the start of the heating operation to facilitate the shape change and may not need any or less power during the course of the heating operation. The controller may be configured for controlling power supply to the heating portion and the shape changing portion separately to optimally facilitate heating of the aerosol-generating substrate and shape change of the heating element by the shape changing portion. The heating controller of the controller is configured to control power supply to the heating portion. The power supply to the heating portion may be configured for optimizing aerosol generation. The power supplied to the shape changing portion may be configured to optimize shape change of the heating element. An electric insulating layer may be arranged between the shape changing portion and the heating portion to facilitate separate power supply circuits between the heating portion and the shape changing portion.

The heating element may be configured as a heating pin or blade or needle. The shape changing portion and the heating portion may be arranged along the longitudinal length of the heating element.

The shape changing portion may be arranged next to the heating portion. Providing the shape changing portion together with the heating portion along the longitudinal length of the heating element may optimize the shape changing properties of the heating element. In this regard, the shape change of the shape changing portion may optimally result in a shape change of the heating portion.

The shape changing portion may be centrally aligned in the heating element and the heating portion may be arranged surrounding the shape changing portion, or the heating portion may be centrally aligned in the heating element and the shape changing portion may be arranged surrounding the heating portion.

Arranging the shape changing portion centrally and the heating portion surrounding the shape changing portion may optimize heat transfer from the heating portion towards the aerosol-generating substrate. The heating element may be configured as a coil, sleeve or resistive coating. Arranging the heating portion centrally and the shape changing portion surrounding the heating portion may optimize force transmission from the shape changing portion towards the heating portion thereby facilitating shape change of the heating portion as a result of shape change of the shape changing portion. The heating element is preferably configured elastic.

The change of shape of the heating element may be induced by specific temperature ranges, light with specific wavelengths, applying electricity, applying a magnetic field, other physical triggers or chemical triggers.

Preferably, the shape change is induced by applying an electric voltage to the shape changing portion. In this regard, the controller of the device may be configured to control power supply from the battery towards the shape changing portion so that electric power flows from the battery into the shape changing portion thereby facilitating shape change of the heating element.

The heating element may be configured as a heating pin or blade, wherein the heating element may be configured to expand outwards, preferably into multiple segments, during the heating operation. This configuration of the heating element may also be denoted as enabling the heating element to extend outwards or to deform outwards.

The term "expand outwards" refers to a movement of the heating element from the central longitudinal axis of the heating element, which is identical to the central longitudinal axis of the heating chamber, outwards towards the walls of the heating chamber. This movement may also be denoted as radial outward movement. Providing the heating element having multiple segments has the benefit that the heat distribution from the heating element towards the aerosol-generating substrate may be optimized. Also, the retention force holding the aerosol-generating article in the heating chamber may be increased during expansion of the heating element.

The heating element may be made from a folded strip of shape memory material configured to expand outwards during the heating operation.

The folded strip of shape memory material may have a shape such that two folded layers together constitute the shape changing portion of the heating element. During the heating operation, the two layers may start to curve outwards, thereby pushing against the aerosol-generating substrate.

The heating element may comprise coils around its surface or scales arranged on the surface, wherein the coils or scales may be arranged to expand outwards during the heating operation.

The coils are provided as multiple little coils around the surface of the heating element. During the heating operation, the ends of the coils may extend outwards. The final shape of this embodiment may look like a barbed wire. After the end of the heating operation, the coils return to their original shape. Afterwards, the aerosol-generating article can easily be removed from the heating element. When the heating element comprises scales, these scales may bend outwards during the heating operation. Thus, the contact surface between the heating element and the aerosol-generating substrate may be increased. Again, after the end of the heating operation, the scales may bend backwards towards the heating element, thereby facilitating a smooth heating element. Other elements such as wedges, plates or similar elements may be provided on the outer surface of the heating element for achieving a similar effect.

The device may comprise a retraction mechanism connected to the heating element, wherein the retraction mechanism may be configured to change its shape for retracting the heating element from the heating chamber and pushing the heating element into the heating chamber.

The retraction mechanism may be arranged outside of the heating chamber. The retraction mechanism may be provided for facilitating retraction of the heating element from the heating chamber. In this way, insertion and removal of an aerosol-generating article may be made easier. The retraction mechanism preferably comprises a shape changing material such as described above with reference to the heating element and the shape changing portion. The shape change of the retraction mechanism may be controlled similarly by the controller. In this regard, the controller preferably comprises a retraction controller for separately controlling the retraction of the heating element from the heating chamber by means of the retraction mechanism.

The retraction mechanism may also be configured to push the heating element back into the heating chamber after retracting the heating element from the heating chamber. The retraction mechanism may be utilized to retract the heating element from the heating chamber when no aerosol-generating article is inserted into the heating chamber and to ease insertion of an article. When an aerosol-generating article is inserted to a heating chamber, the retraction mechanism is preferably configured to push the heating element back into the heating chamber so that the heating element penetrates into the aerosol-generating article.

After depletion of the article, the heating element may be retracted again from the heating chamber to ease removal of the article.

Between the retraction mechanism and the heating element, a support element may be arranged. The support element may be arranged for securely holding the heating element. The support element may be configured electrically insulating such that the heating element and the retraction mechanism can be controlled separately. Preferably, a separate power supply circuit is provided between the controller and the heating element and between the retraction mechanism and the controller.

The heating chamber may comprise an opening at the base of the heating chamber for facilitating retraction and pushing of the heating element. A cleaning element may be arranged near the opening to scrape off unwanted residues from the heating element during retraction of the heating element from the heating chamber. The cleaning element may be provided as a bead or ring or similar structure contacting the heating element. The cleaning element may be arranged in a position inside the heating chamber such that the shape change of the heating element automatically removes unwanted debris from the surface of the heating element.

Multiple heating elements may be provided. The multiple heating elements may each be provided to change shape during a heating operation. Also, only one or multiple heating elements may be provided to change shape during a heating operation, while other heating elements or a single other heating element may be provided to not change shape during the heating operation.

The present invention further relates to a method for generating an inhalable aerosol with an aerosol-generating device. The method comprises the following steps:

i) providing an aerosol-generating device comprising a heating chamber configured to receive an aerosol-generating article containing aerosol-generating substrate and a heating element arranged in the heating chamber, wherein the heating element comprises one or more of a shape memory alloy, a shape memory polymer, a shape memory ceramic and bimetal;
ii) inserting an aerosol-generating article into the heating chamber;
iii) penetrating the aerosol-generating article with the heating element; and
iv) heating the heating element, wherein the heating element changes its shape during the heating operation.

Figures 3, 3A, 3B:
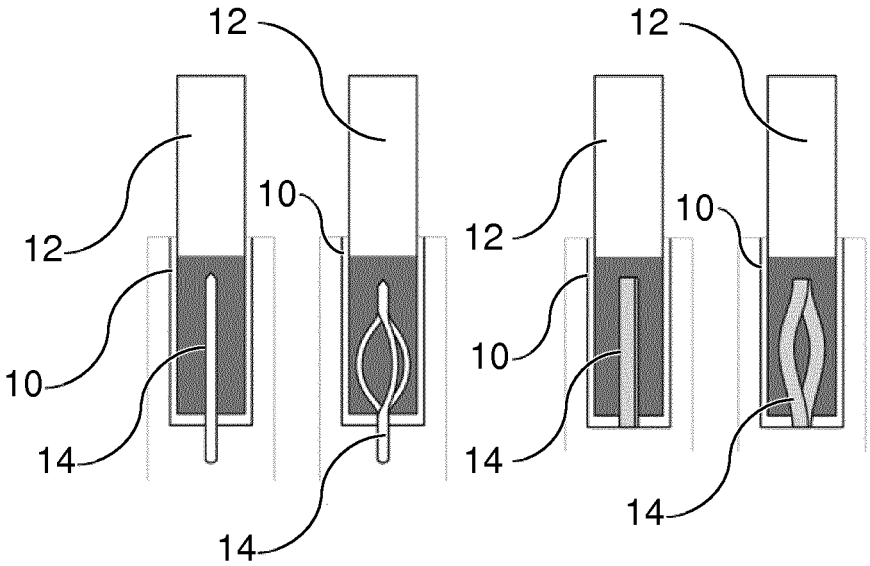
Figures 4, 4A, 4B:
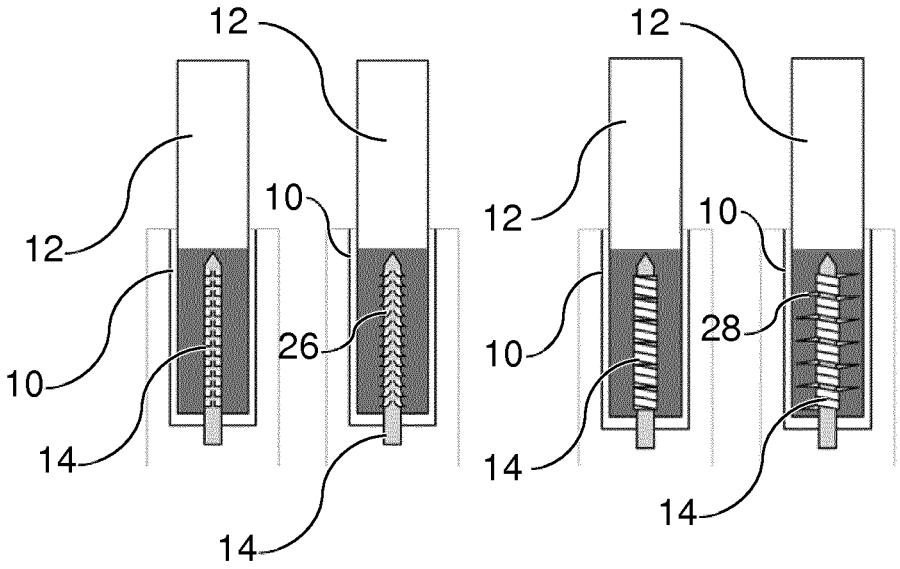

The invention will be described in more detail in the following with reference to the accompanying drawings, which show in:

FIG. 1: an aerosol-generating device according to the present invention with a heating element configured to change its shape during a heating operation;

FIG. 2: embodiments of the heating element;

FIG. 3: further embodiments of the heating element;

FIG. 4: further embodiments of the heating element; and

Figures 5, 5A, 5B, 5C:
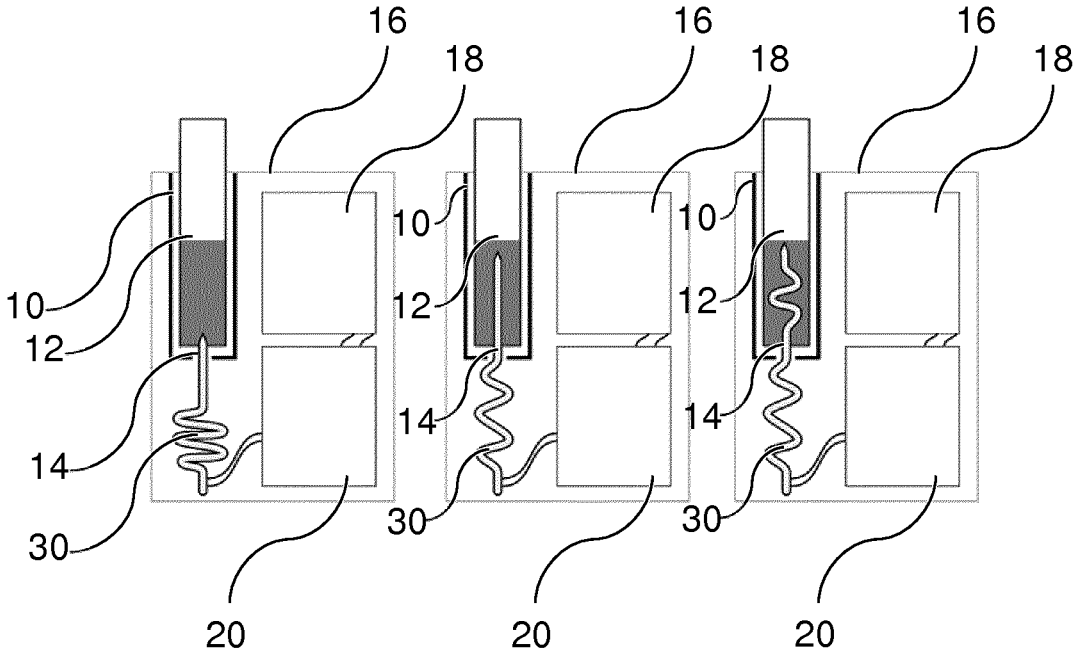

FIG. 5: an embodiment of the aerosol-generating device with a retraction element configured to change its shape.

FIG. 1 shows an aerosol-generating device according to the present invention. The device comprises a heating chamber 10 into which an aerosol-generating article 12 can be inserted. The aerosol-generating article 12 comprises aerosol-generating substrate containing tobacco. In the heating chamber 10, a heating element 14 is arranged. The heating element 14 is provided as a heating blade being centrally aligned along the longitudinal axis of the heating chamber 10.

The device further comprises a housing 16. Inside of the housing 16, a power supply 18 in the form of a battery and a controller 20 are arranged.

The left part of FIG. 1, FIG. 1A, shows the heating element 14 before a heating operation. The heating element 14 is configured as a straight heating blade and the aerosol-generating article 12 is inserted to the heating chamber 10. The heating element 14 thus penetrates into the aerosol-generating article 12 easily due to the straight shape of the heating element 14. In the right part of FIG. 1, FIG. 1B, the heating element 14 is shown in a configuration which is achieved during the heating operation. In this regard, the controller 20 controls supply of energy from the power supply 18 towards the heating element 14. The heating element 14 is thus heated. The heating of the heating element 14 induces a shape change of the heating element 14. During the heating operation, the shape of the heating element 14 changes to optimize the contact surface between the heating element 14 and the aerosol-generating substrate as well as retain the aerosol-generating article 12 within the heating chamber 10.

FIG. 2 shows different embodiments of the heating element 14. In FIG. 2A, the heating element 14 comprises a heating portion 22 and a shape changing portion 24. The heating portion 22 and the shape changing portion 24 are aligned together centrally along the longitudinal length of the heating element 14. During operation of the heating element 14, the shape changing portion 24 changes shape thereby inducing a shape change of the heating portion 22. In FIG. 2B, the heating element 14 also comprises a shape changing portion 24 as well as a heating portion 22. However, the heating portion 22 is arranged surrounding the shape changing portion 24 so that the heat transfer from the heating portion 22 towards the aerosol-generating substrate is increased. In other embodiments, the positioning of the shape changing portion 24 and the heating portion 22 may be reversed. In FIG. 2C, the shape changing portion 24 is arranged enclosing the heating portion 22 so that the force transmitted from the shape changing portion 24 towards the heating portion 22 during shape change is optimized. The heating portion 22 is preferably configured elastic such that the heating portion 22 as well as the shape changing portion 24 return to the initial position after the end of the heating operation.

FIG. 3 shows two further embodiments of the heating element 14. In FIG. 3A, the heating element 14 consists of multiple segments which spread outwards during the heating operation. FIG. 3B shows an embodiment in which the heating element 14 or at least the shape changing portion 24 of the heating element 14 consists of a folded strip which also expands outwards during the heating operation.

FIG. 4 shows two further embodiments of the heating element 14. FIG. 4A shows an embodiment in which multiple scales 26 are provided on the outer surface of the heating element 14. These scales 26 bend out once during the heating operation. FIG. 4B shows an embodiment in which multiple small coils 28 are coiled around the outer surface of the heating element 14. During operation of the heating element 14, these coils 28 expand outwards so that the heating element 14 looks like a barbed wire. For all embodiments, the heating element 14 preferably returns to the initial position after the end of the heating operation so that the aerosol-generating article 12 can easily be removed from the heating chamber 10.

FIG. 5 shows an embodiment in which a retraction mechanism 30 is provided. A retraction mechanism 30 is provided for retracting the heating element 14 from the heating chamber 10 and later pushing the heating element 14 back into the heating chamber 10. The retraction mechanism 30 is also provided as an element which can change its shape. The retraction mechanism 30 preferably is arranged as a shape memory material such as a shape memory alloy. In FIG. 5, only one controller 20 is depicted which controls the retraction mechanism 30 together with the heating element 14. However, the controller 20 may comprise multiple controllers such as a heating portion controller for controlling a heating portion of the heating element 14, shape changing portion controller for controlling the shape change of the heating element 14 and a retraction controller for controlling the retraction and pushing of the heating element 14. The controllers may be controlled separately. Also not shown in FIG. 5, a support element may be arranged between the retraction mechanism 30 and the heating element 14 for electrically insulating the retraction mechanism 30 from the heating element 14. Preferably, during operation, the aerosol-generating article 12 is inserted into the heating chamber 10 while the heating element 14 is retracted from the heating chamber 10. Then, the retraction mechanism 30 is activated so as to push the heating element 14 into the heating chamber 10 thereby penetrating the aerosol-generating article 12. Then, the heating element 14 is activated so as to deform so that the contact surface between the heating element 14 and the aerosol-generating substrate in the aerosol-generating article 12 is increased. After the heating operation has ended, the heating element 14 is preferably returned to its initial state and retracted from the heating chamber 10 by means of the retraction mechanism 30 so that the aerosol-generating article 12 can be easily removed from the heating chamber 10 and a fresh aerosol-generating article 12 can be introduced into the heating chamber 10.

The invention claimed is:

1. An aerosol-generating device for generating an inhalable aerosol, the aerosol-generating device comprising:

a heating chamber configured to receive an aerosol-generating article containing an aerosol-generating substrate; and a heating element disposed in the heating chamber, wherein material of the heating element is configured to penetrate into the aerosol-generating article, and wherein the material of the heating element comprises one or more of a shape memory alloy, a shape memory polymer, and a shape memory ceramic.

2. The aerosol-generating device according to claim 1, wherein the heating element is configured to change shape during a heating operation.

3. The aerosol-generating device according to claim 1, wherein the heating element is configured to change shape for a duration of a heating operation.

4. The aerosol-generating device according to claim 1, wherein the heating element is configured to change shape continuously for a duration of a heating operation.

5. The aerosol-generating device according to claim 1, wherein the heating element consists of a shape memory alloy, a shape memory polymer, a shape memory ceramic, or a bimetal.

6. The aerosol-generating device according to claim 1, wherein the heating element comprises a shape changing portion and a heating portion.

7. The aerosol-generating device according to claim 6, wherein the heating portion is elastic.

8. The aerosol-generating device according to claim 6, further comprising a power supply and a controller, wherein the controller comprises a shape changing controller configured to control a power supply to the shape changing portion, wherein the controller further comprises a heating controller configured to control a power supply to the heating portion, and wherein supply circuits of the shape changing portion and the heating portion are configured as separate power supply circuits.

9. The aerosol-generating device according to claim 6, wherein the heating element is configured as a heating pin or a blade, and wherein the shape changing portion and the heating portion are arranged along a longitudinal length of the heating element.

10. The aerosol-generating device according to claim 9, wherein the shape changing portion is centrally aligned in the heating element and the heating portion is arranged surrounding the shape changing portion, or wherein the heating portion is centrally aligned in the heating element and the shape changing portion is arranged surrounding the heating portion.

11. The aerosol-generating device according to claim 1, wherein the heating element is configured to change shape during a heating operation, and wherein the change of shape of the heating element is induced by specific temperature ranges, and/or light with specific wavelengths, and/or applying electricity, and/or applying a magnetic field, and/or other physical triggers, and/or chemical triggers.

12. The aerosol-generating device according to claim 1, wherein the heating element is configured as a heating pin or blade, and wherein the heating element is further configured to expand outwards during a heating operation.

13. The aerosol-generating device according to claim 12, wherein the heating element is further configured to expand outwards into multiple segments during a heating operation.

14. The aerosol-generating device according to claim 1, wherein the heating element is made from a folded strip of shape memory material configured to expand outwards during a heating operation.

15. The aerosol-generating device according to claim 1, wherein the heating element comprises coils around a surface of the heating element, or comprises scales arranged on the surface, and wherein the coils or the scales are configured to expand outwards during a heating operation.

16. The aerosol-generating device according to claim 1, further comprising a retraction mechanism connected to the heating element, and wherein the retraction mechanism is configured to change shape for retracting the heating element from the heating chamber and for pushing the heating element into the heating chamber.

17. A method for generating an inhalable aerosol with an aerosol-generating device, the method comprising the following steps:

i) providing an aerosol-generating device comprising a heating chamber configured to receive an aerosol-generating article containing an aerosol-generating substrate and a heating element disposed in the heating chamber, wherein material of the heating element comprises one or more of a shape memory alloy, a shape memory polymer, and a shape memory ceramic;

ii) inserting an aerosol-generating article into the heating chamber;

iii) penetrating the aerosol-generating article with the heating element; and iv) heating the heating element, wherein the heating element changes shape during the heating operation.

* * * * *